US006111186A

United States Patent [19]

Krozack et al.

[11] Patent Number: 6,111,186

[45] Date of Patent: Aug. 29, 2000

[54] SIGNAL PROCESSING CIRCUIT FOR STRING INSTRUMENTS

[75] Inventors: Edwin Krozack, Chester; Paul Reed Smith, Lothian, both of Md.

[73] Assignee: Paul Reed Smith Guitars, Stevensville, Md.

[21] Appl. No.: 09/348,342

[22] Filed: Jul. 8, 1999

Related U.S. Application Data

[60] Provisional application No. 60/092,224, Jul. 9, 1998.

[51] Int. Cl.[7] ..... G10H 1/12

[52] U.S. Cl. ..... 84/736; 84/733

[58] Field of Search ..... 84/735, 736, 733

[56] References Cited

U.S. PATENT DOCUMENTS

| | | |
|---|---|---|
| 3,213,180 | 10/1965 | Cookerly et al. . |
| 3,591,699 | 7/1971 | Cutler . |
| 3,813,473 | 5/1974 | Terymenko . |
| 4,228,715 | 10/1980 | Nourney . |
| 4,357,852 | 11/1982 | Suenaga . |
| 4,584,923 | 4/1986 | Minnick . |
| 4,879,937 | 11/1989 | Hirano . |
| 4,919,031 | 4/1990 | Matsumoto . |
| 5,065,659 | 11/1991 | Uchiyama et al. . |
| 5,117,730 | 6/1992 | Yamauchi . |
| 5,218,160 | 6/1993 | Grob-Da Veiga . |
| 5,591,931 | 1/1997 | Dame . |
| 5,877,447 | 3/1999 | Vice . |
| 5,942,709 | 8/1999 | Szalay . |

FOREIGN PATENT DOCUMENTS

| | | |
|---|---|---|
| 2720182 | 11/1995 | France . |
| 2750526 | 1/1998 | France . |
| 1970930A1 | 11/1997 | Germany . |
| 3-179399 | 8/1991 | Japan . |
| 6-110464 | 4/1994 | Japan . |
| WO87/0331 | 1/1987 | WIPO . |

OTHER PUBLICATIONS

Transducers and Electronics for Acoustic Instrument Amplification, Fishman, Winter 1998.

*Primary Examiner*—Jeffrey Donels
*Attorney, Agent, or Firm*—Barnes & Thornburg

[57] ABSTRACT

A signal processing circuit, for each string of a musical instrument which string is individually tuned to a frequency, includes a transducer adjacent to the string and an equalizer connected to an output circuit. To emulate an acoustic instrument, the equalizer is set to emphasize a signal present in a frequency range of the tuned frequency of the string and/or its harmonics. It also de-emphasizes at least low end frequencies below the operating range of the string. A mid-range frequency device is provided in the equalizer to produce characteristic mid-range response for a specific acoustic instrument. If the transducer produces an inherent resonance at a characteristic frequency, the equalizer will also de-emphasize the inherent resonance produced by the transducer at the characteristic frequency of the transducer.

27 Claims, 8 Drawing Sheets

SIGNAL PROCESSING CIRCUIT FOR STRING INSTRUMENTS

CROSS-REFERENCE

This application claims the benefit of U.S. Provisional Application Ser. No. 60/092,224 filed Jul. 9, 1998 which is incorporated herein by reference.

SUMMARY AND BACKGROUND OF THE INVENTION

The present invention relates generally to electrical string musical instruments, and more specifically, to an improved signal processing circuit for the strings to emulate acoustic string musical instruments.

Musical instruments, for example, electric guitars, have a number of strings, connected between a bridge on the body and tuning pegs at the headstock. The vibration of the strings are sensed by transducers or pickups which are then signal processed and amplified. Typically, one or more transducers pick up the signal of all the strings simultaneously and provide a mono or single output of the combined signals. It has been known also to provide an individual transducer for each string and then combine the signals at a single mono output. The transducers are generally inductor coils. Depending on the location and type of transducer, the transducers do not sense the same vibrations as an acoustic instrument.

Instead of providing individual coils to pick up the signal of the individual strings, the use of individual piezoelectric transducers at the bridge have been used to pick up the signals from the individual strings. The signals again have been combined in a signal processing circuit to provide a mono output.

The signal processing of individual pickup from a string instrument to produce harmonic overtones and undertones are described in U.S. Pat. Nos. 3,213,180 and 5,218,160. Examples of individual signal processors for individual pickups for each string with signal modification to produce effects are described in U.S. Pat. No. 3,813,473, U.S. Pat. No. 4,357,852, Japanese Patent 6-110464 dated Apr. 22, 1994 and WO 87/00331. In U.S. Pat. No. 3,813,473, the effects to be produced are sustained-note effect, removal of sympathetic vibrations among strings and removal of the initial click sound produced by the plucking of the string. In U.S. Pat. No. 4,357,852, it uses a voltage controlled variable bandpass filter to follow and extract the fundamental in the guitar sound for each string. The extracted fundamental is then modulated with an envelope signal for synthesizing. In the Japanese Patent 6-110464, the effects are distortion and ululation. WO 87/00331 includes effects devices, such as reverberation, flanger and echo or delay devices. A compensation circuit for piezoelectric pickups in musical instruments is described in U.S. Pat. No. 5,877,447.

The present invention is a signal processing circuit for musical instruments, the musical instrument having a plurality of strings individually tuned to a frequency ranging from an open string to a fretted string. A signal processing circuit is provided for each string and includes a transducer adjacent to the string and an equalizer connected to an output circuit. The equalizer is set to emphasize signals present in a frequency range of the tuned frequency range of the respective string. The set frequency range of the equalizer may be the fundamental and/or one or more of the harmonics of the fundamentals of the individual string. Also, the equalizer de-emphasizes at least the low end frequency below the operating range for that string. The resulting or output signal emulates an acoustic instrument of the same type of instrument.

A mid-range frequency device is provided in the equalizer to produce characteristic mid-range response for a specific acoustic instrument. If the equalizer includes a digital signal processor, it can determine the frequency of the string and emphasize the determined frequency and its harmonics.

The stringed musical instrument can be selected from any string musical instrument, for example guitars, basses, mandolins, violins and cellos, pianos, harps, etc. Where the string instrument is a six stringed guitar, for example, the equalizers for the respective strings emphasize the tuned range of frequency of the fundamental, which can be one octave. For a bass, the equalizer for the respective string emphasizes one or more of the fundamental frequency and/or one or more of its harmonics within the tuned frequency range of the respective string.

Wherein the transducer is a piezoelectric transducer which contacts the string, the equalizer also de-emphasizes inherent resonance produced by the piezoelectric transducer. Where the stringed instrument includes a bridge supporting the strings, the transducers may be provided on the bridge. If other forms of transducers produce an inherent resonance at a characteristic frequency, the equalizer will also de-emphasize the inherent resonance produced by the transducer at the characteristic frequency of the transducer. A filter is used to de-emphasize the inherent resonance produced by the transducer at its characteristic frequency. For example, for piezoelectric transducers, the de-emphasized the inherent resonance is in the 6000–12000 hertz range.

The portion of the signal processing circuit which de-emphasizes the inherent resonance produced by the transducer may be in each equalizer for the strings. Alternatively, a single de-emphasizing circuit may be provided where a mono output is used. If a stereo output is used, a pair of circuits to de-emphasize the characteristic resonance of the transducer would be used.

Other objects, advantages and novel features of the present invention will become apparent from the following detailed description of the invention when considered in conjunction with the accompanying drawings.

DETAILED DESCRIPTION OF THE PREFERRED EMBODIMENTS

Although the present invention will be described with respect to an electric guitar and electric bass, it may be applied to any other string musical instrument. Some examples are mandolins, violins, cellos, pianos, harps, etc. The invention is directed to a transducer and signal processing circuit for electrical musical string instruments, and preferably to emulate an acoustic sound. A transducer and signal processing circuit or equalizer is provided for each string and connected to an output circuit.

Figure 1:
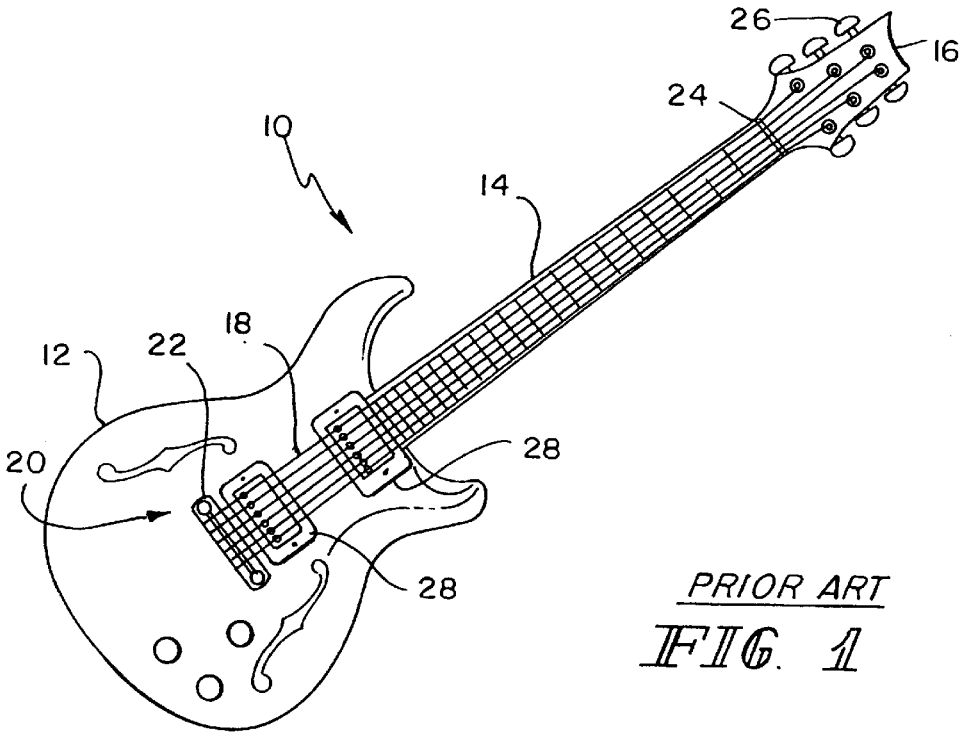
PRIOR ART FIG. 1
FIG. 1 is a plan view of a musical instrument, for example, a guitar of the prior art.
Figure 2:
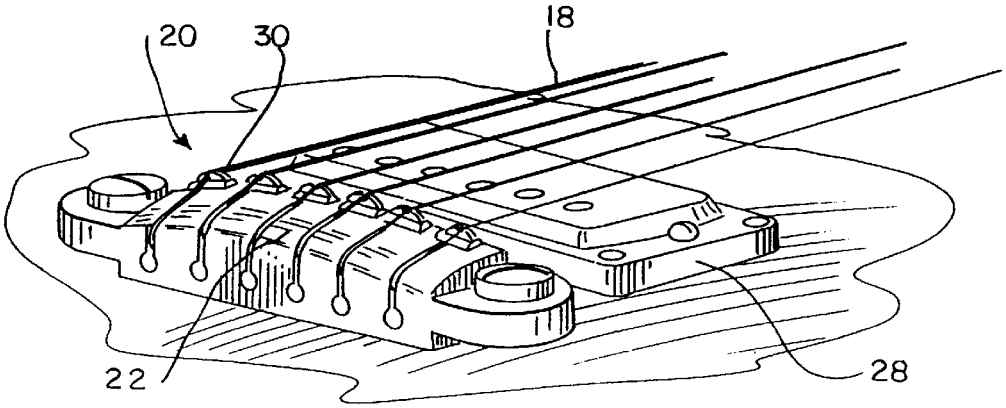
PRIOR ART FIG. 2
FIG. 2 is a perspective view of a bridge pickup arrangement of the guitar of the prior art.

A typical musical instrument, for example, a guitar 10 illustrated in FIG. 1, includes a body 12, a neck 14 and a headstock 16. A plurality of strings 18, for example six strings in this example, are connected between a bridge 20 having saddles 22, a nut 24 and tuning pegs 26. Two pickups 28 are shown in the body 12 of the guitar. These pickups or transducers are each generally a single inductor which picks up and combines the movement of the strings to produce a single output. A typical bridge 20 and saddle 22 are illustrated in FIG. 2. The saddle 22 includes a piezoelectric transducer 30 at the brake point of each of string 18. A lead connects the transducer 30 to the signal processing circuit.

Figure 3:
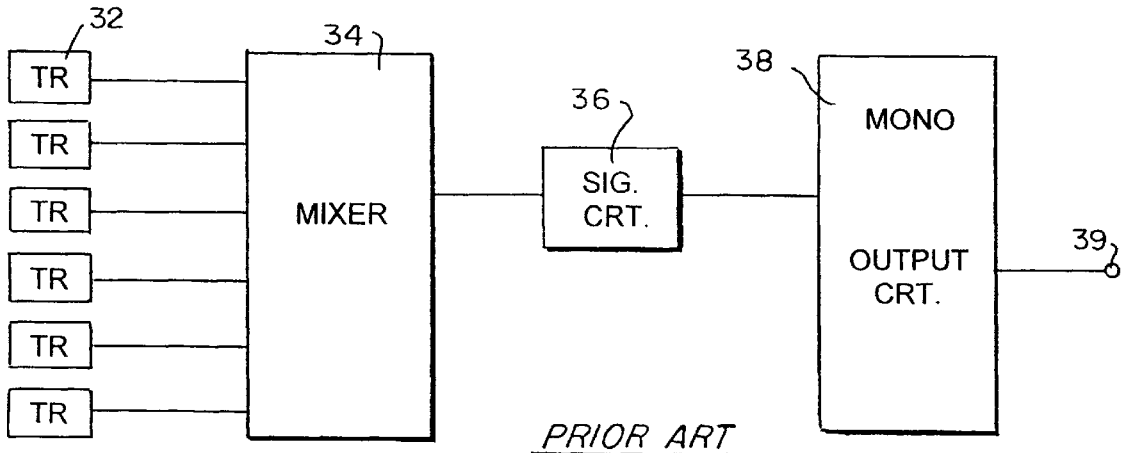
PRIOR ART FIG. 3
FIG. 3 is a schematic of the electrical pickup and signal processing circuit of the prior art.

A signal processing circuit of the prior art using a single transducer for each of the strings of the six strings is illustrated in FIG. 3. The six transducers 30 are connected by wires 32 to a single mixer 34 whose output is connected to a signal processing circuit 36 whose output is connected to a mono output circuit 38 having an output 39. The signal processing circuit 36 may be, for example, an equalization circuit to produce a particular effect but works on the combined signal of all the transducers 32. A circuit equivalent to that of FIG. 3 using a piezoelectric transducer is available from LR Baggs of Nipomo, Calif.

Figure 4:
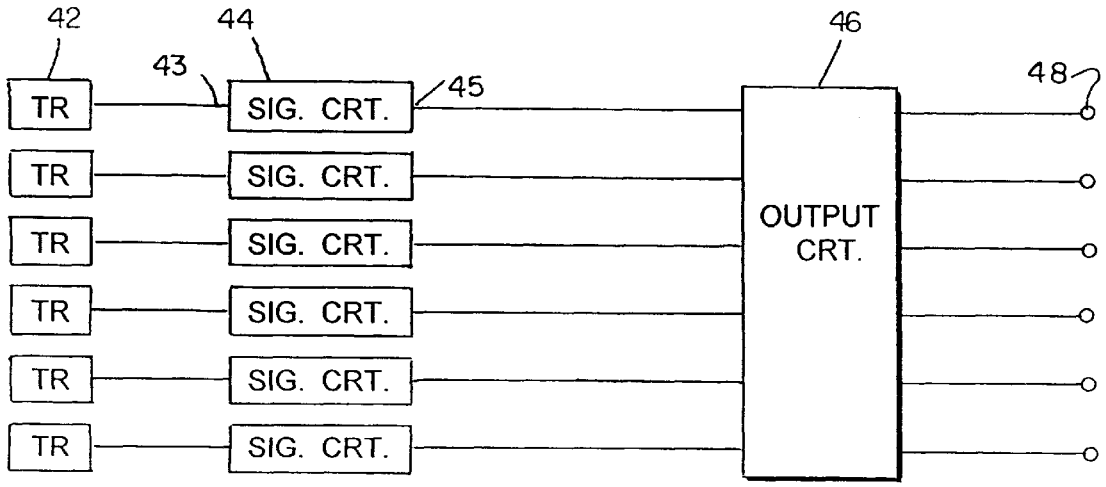
FIG. 4 is a schematic of a hexaphonic pickup and signal processing circuit of the present invention.
Figure 8:
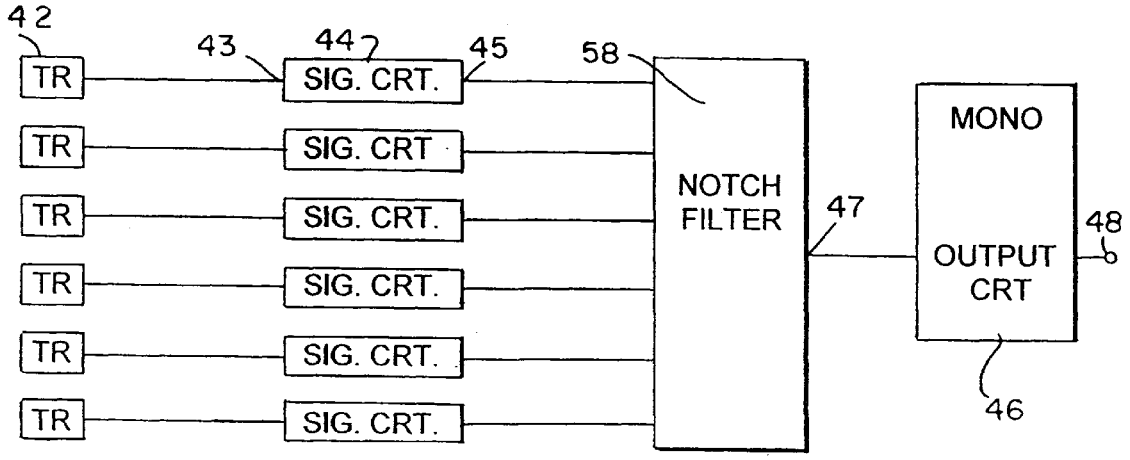
FIG. 8 is a schematic of a transducer and signal processing circuit with a mono output incorporating the principles of the present invention.
Figure 9:
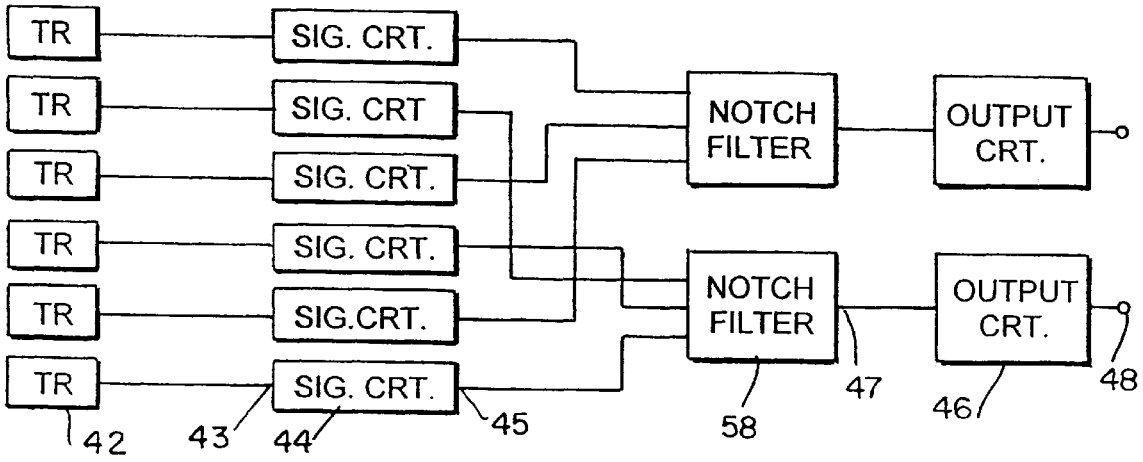
FIG. 9 is a schematic of a transducer and signal processing circuit for a stereo output incorporating the principles of the present invention.

In order to provide a sound from an electrical string instrument which emulates an acoustic string instrument, the circuit of FIG. 4 is required. Again, using the example of a six string guitar where each of the strings are tuned to a different frequency, six transducers 42 are provided with their own signal processing circuit or equalizer 44 and are connected at input 43 thereof. The output 45 of the signal processing circuit 44 is connected to an output circuit 46. As illustrated in FIG. 4, six separate outputs 48 are provided. This is known as a hexaphonic circuit. The output circuit 46 may provide a mono output as illustrated in FIG. 8 or a stereo output as illustrated in FIG. 9.

Each of the signal circuits 44 are set to the fundamental frequency range of the tuned string to which its transducer is adjacent. For a six string guitar, the fundamental range is the range from an open string to a string fretted at the 24th fret. The fundamental range from open to the 12th fret is one octave. For strings tuned to low frequencies, the signal circuits are set to a frequency range of one or more harmonics of the fundamental frequency of the string. A signal processing 44 emphasizes the fundamental or harmonics frequency range of the respective tuned string and preferably de-emphasizes low end frequencies and, as needed, de-emphasize high end frequencies outside the frequency range of the tuned string. The elimination of low end signals outside the frequency range of the string is important where the transducer is sensitive to any low frequency signal, like thumping on the body.

Figure 6:
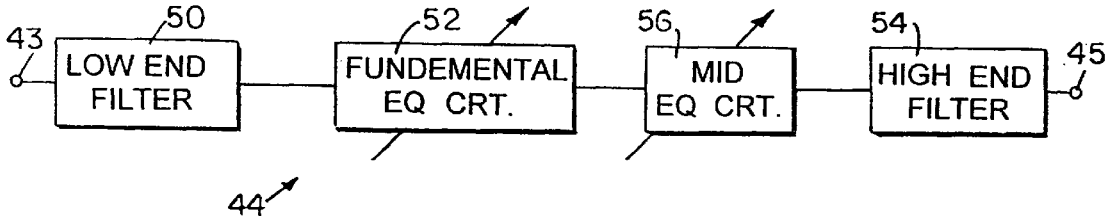
FIG. 6 is another embodiment of the signal processing circuit of FIG. 4.

Also, the signal processing circuit 44 may also modify the mid-range frequencies of a respective string to emulate a particular acoustic characteristic of an acoustic instrument as illustrated in FIG. 6. Where the transducer produces an inherent resonance at a characteristic frequency of the transducer, a signal processor will de-emphasize that characteristic frequency as illustrated in FIGS. 7–11.

Figure 5:
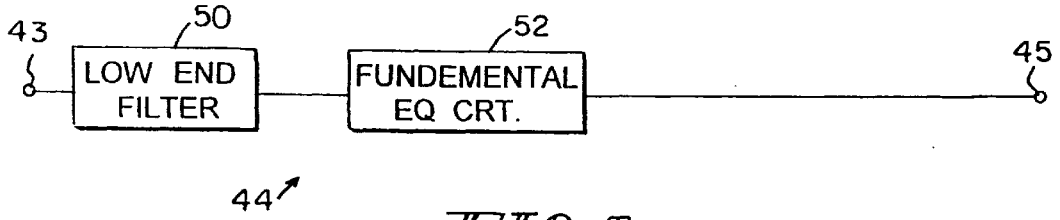
FIG. 5 is a schematic of an embodiment of a signal processing circuit of FIG. 4 according to the principles of the present invention.
Figure 7:
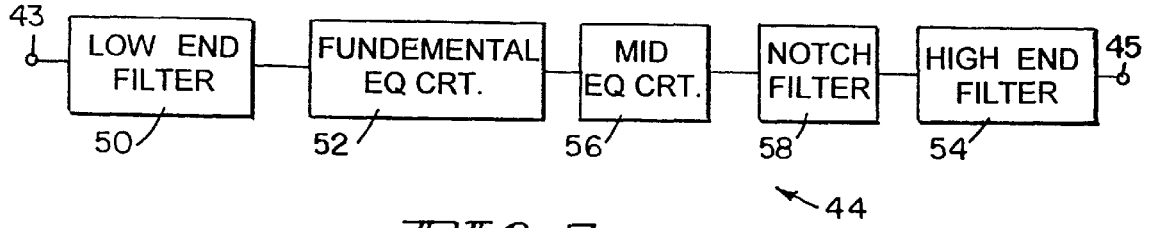
FIG. 7 is a further embodiment of a signal processing circuit of FIG. 4.

A basic signal processing circuit 44 is illustrated in FIG. 5 as including a low end filter 50 and a fundamental frequency and/or one or more of its harmonics equalization circuit 52. For some instruments or strings, the low end filter 50 may be eliminated. If the string does produce high end frequencies which are undesirable, a high end filter 54 can be provided for that string as illustrated in FIGS. 6 and 7. To customize the response of the signal processing circuit 44 to emulate a particular acoustic instrument, each of the equalization circuits 44 may be provided with a mid-frequency equalization circuit 56 as illustrated in FIGS. 6 and 7. A particular instrument may be designed and the mid-range equalization circuit fixed to a particular frequency at the factory or the circuit 56 may be adjustable by the user.

It should also be noted that a fundamental/harmonic equalization circuit 52 may also be adjustable, as indicated in FIG. 6 although it may be in all of the circuits, in center frequency or band width. With an adjustable center frequency, it will allow a narrow band width and allow changing the center frequency of the fundamental/harmonic utilization circuit with fretting, capoing or other tuning modifications of the string. These adjustments will also allow personalizing of the sound of the instrument by the player as well as making the instrument sound like it has either different strings or being a different style of the same or different instruments.

Some transducers introduce an inherent resonance signal at a characteristic frequency of the transducer. For example, some piezoelectric transducers add a particular frequency. One type of piezoelectric sensors produce an inherent resonance signal in the 6 k to 12 k hertz range. A filter 58, for example, a notch filter, may be provided to remove this inherent response as illustrated in FIG. 8. Other types of filters may also be used. Preferably, each of the signal processing circuits 44 will include a filter 58 if the transducer has an inherent resonance or characteristic frequency.

For a mono output, a common filter 58 may be used for all six of the signal processing circuits as illustrated in FIG. 8. The output 45 of the individual signal processing circuits 44 are connected to the single filter 58 whose output 47 is connected to the output circuit 46. A single output 48 from the mono output circuit is provided.

Where a stereo output is provided, a pair of filters 58 may be connected between the individual signal processing circuits 44 and the output circuit 46 is illustrated in FIG. 9. As a typical example, every other string is connected to one of the filters 58 whose outputs 47 is connected to an individual output circuit 46 to provide an output at terminal 48. As well known, the stereo output can also be provided by changing the weight of the distribution of all of the strings to a particular output compared to the weight of the value of all of the strings to the other output of a stereo output.

Figure 10:
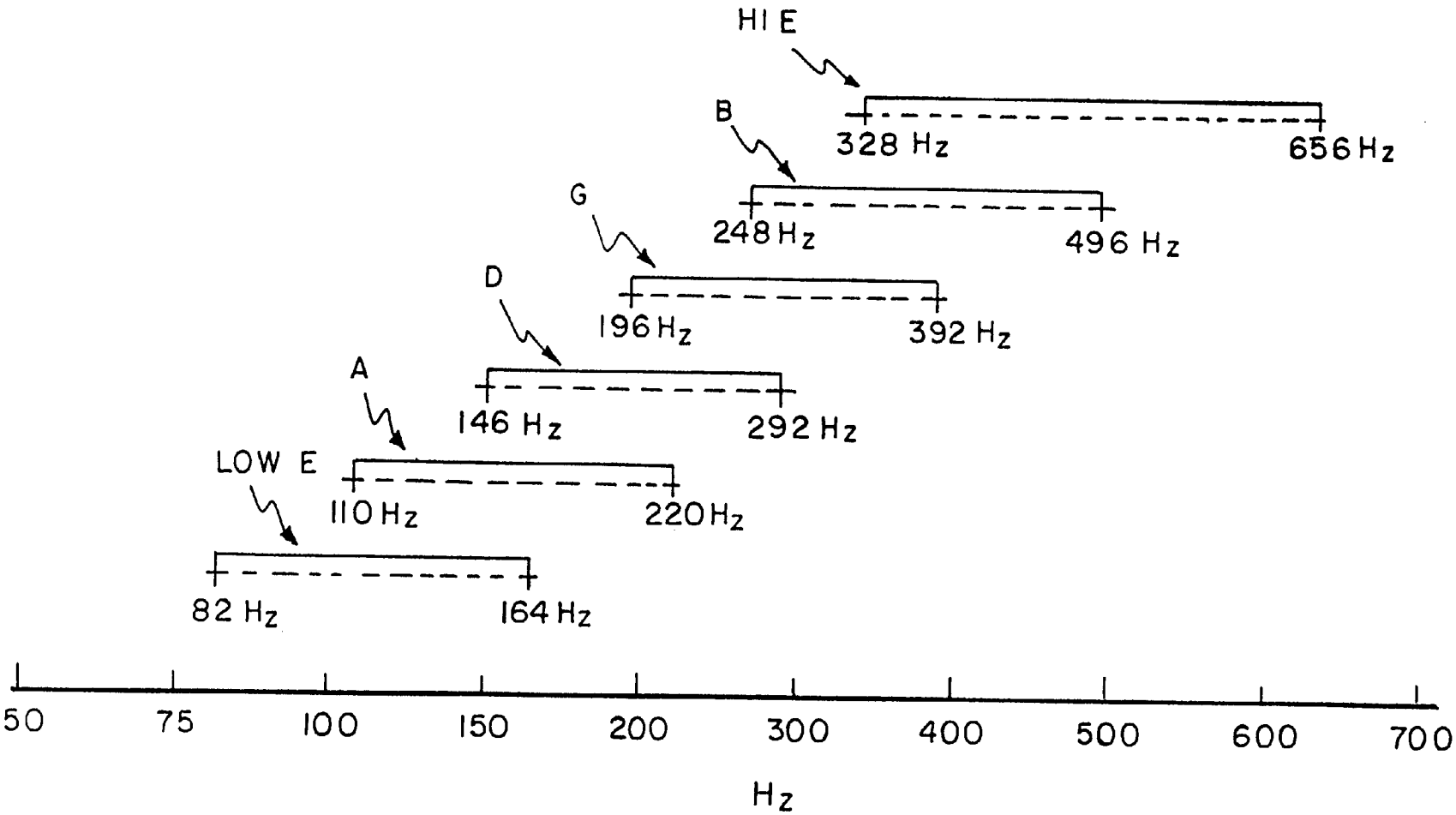
FIG. 10 is a graph of the frequency range of each tuned string shown in dash lines and the EQ signal shown in solid of frequency for a six string guitar according to the principles of the present invention.

Using a six stringed guitar as an example, the individual strings tuned frequency range and consequently the value at which the fundamental equalization circuit 52 of the signal processor 44 is set is shown in Table 1 and FIG. 10.

TABLE 1

| String | Open | EQ Range |
|---|---|---|
| Low E String | 82 Hz | 82 Hz to 164 Hz |
| A String | 110 Hz | 110 Hz to 220 Hz |
| D String | 146 Hz | 146 Hz to 292 Hz |

TABLE 1-continued

| String | Open | EQ Range |
|---|---|---|
| G String | 196 Hz | 196 Hz to 392 Hz |
| B String | 248 Hz | 248 Hz to 496 Hz |
| High E String | 328 Hz | 328 Hz to 656 Hz |

The tuned frequency range for each of the strings is from the open string fundamental frequency to the 12th fretted fundamental frequency which is one octave. The dash line shows the tuned frequency range of the string with the solid line showing the boosted signal frequency range produced by the signal processing circuit 44. In the example shown, each of the fundamental frequency ranges are boosted by, for example, 5 DB. The amount of signal increase is a function of the type of instrument and the location of the transducer. In a guitar, it may vary between 3 to 8 DB.

The open to 12th fret string range of fundamental is the range to be boosted. Although other fundamentals from the 12th to the 22nd or 24th fret may be played, they are played less frequently. The set range of the signal processing circuit 44 may be increased to include more of the tuned fundamentals above the 12th fret.

Figure 11:
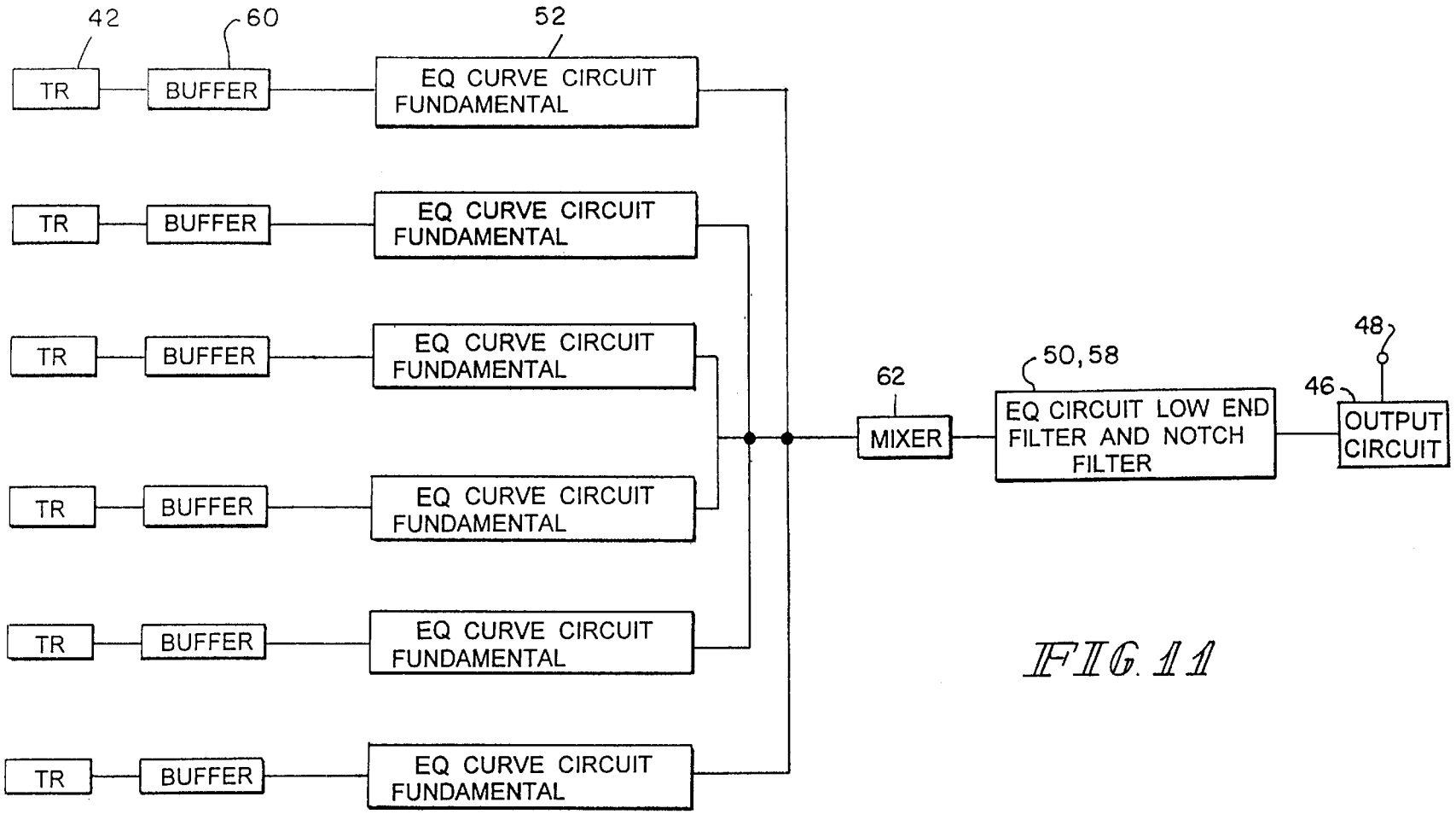
FIG. 11 is a circuit according to the principles of the present invention for a six string guitar.

One specific implementation for a guitar using the curves of FIG. 10 is illustrated in FIG. 11. Six transducers 42 are connected through six buffers 60 to the EQ circuit for the fundamental curve 52. The output of the six EQ curve circuit 52 are combined in a mixer 62 and provided to an EQ circuit for low end rolloff 50 and notch filter 58. The output is provided to output circuit 46.

As discussed with respect to FIG. 10, the EQ curve circuit 52 is set to the specific fundamental range of the string and is increased 5 DB relative to the harmonics present in the signal. The low end roll off filter 50 may, for example, be a 50 hertz low end rolloff at 12 DBs per octave. This is to remove the signal which is outside the operating range of the tuned string. The notch filter 58 is set for the particular transducer which may be, for example, a piezoelectric transducer. In this instance, an 8 k hertz cut is used with a negative 8 DB adjustment.

Figure 12:
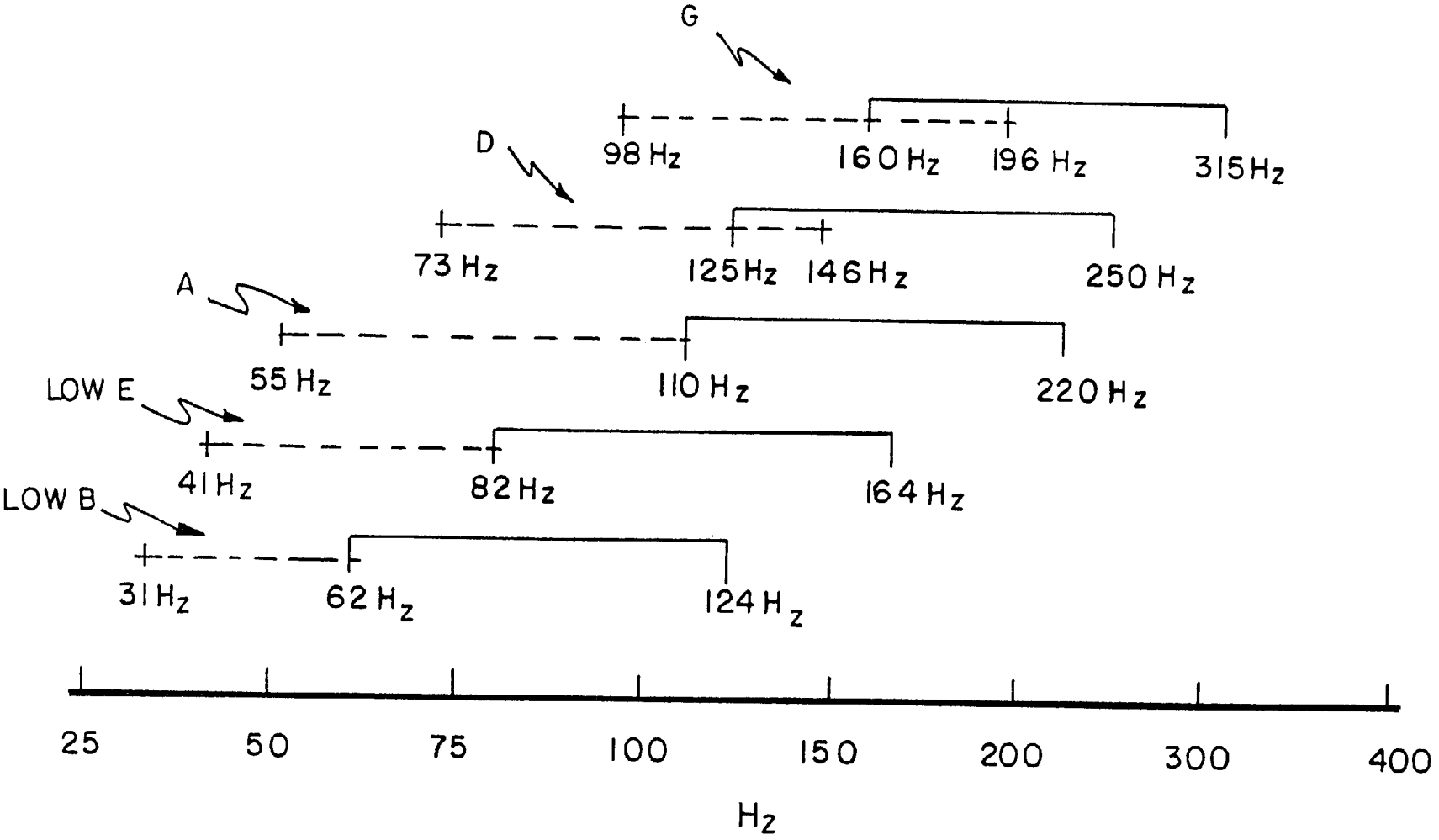
FIG. 12 is a graph of the frequency range of each tuned string shown in dash lines and the EQ signal shown in solid of frequency for a five string bass according to the principles of the present invention.

Using a five stringed bass as a further example, the individual strings tuned range and consequently the value at which the fundamental/harmonic equalization circuit 52 of the signal processor 44 is set is shown in Table 2 and FIG. 12.

TABLE 2

| String | Peak | EQ Range |
|---|---|---|
| Low B String | 31 Hz | 62 Hz to 124 Hz |
| Low E String | 41 Hz | 82 Hz to 164 Hz |
| A String | 55 Hz | 110 Hz to 220 Hz |
| D String | 73 Hz | 125 Hz to 250 Hz |
| G String | 98 Hz | 160 Hz to 315 Hz |

The ranges are selected to encompass and emphasize the first and the second harmonics. For low frequency strings, the fundamental or first harmonic is lower in energy and not as audible as the second and following harmonics.

The curve for the bass of Table 2 is shown in FIG. 12. The dashed line for each of the strings indicates its tuned frequency range from an open to the 12th fretted string, and the solid lines indicate the range for the boosted signal. For the low B, low E and A, it will be noted that none of the tuned fundamental signal is being boosted. The boost is in the second harmonic from the open to the 12th fretted second harmonic. The D and G include some first harmonic or fundamental and the second harmonic. The boost again, for example, may be 5 DB.

Figure 13:
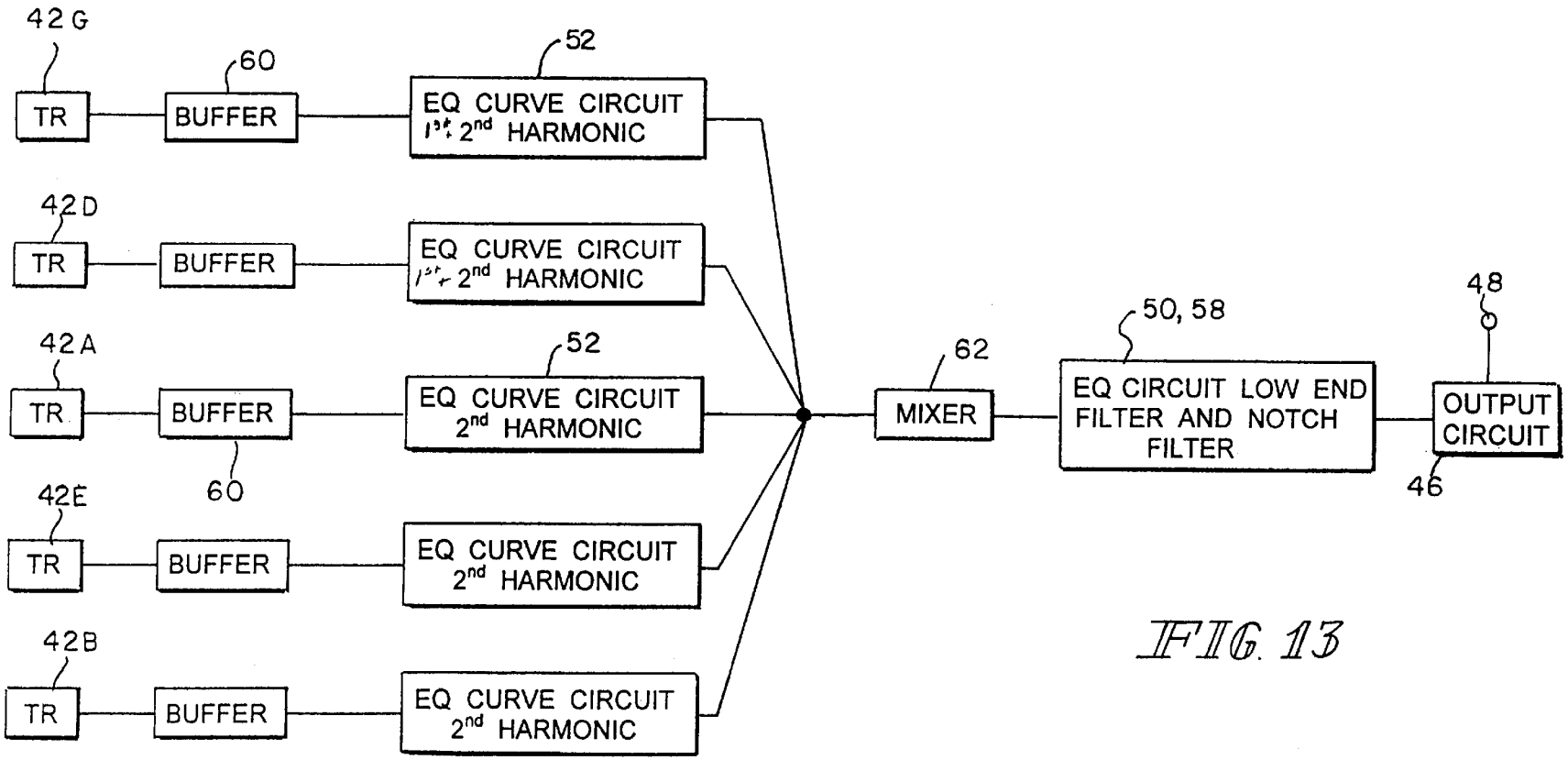
FIG. 13 is a circuit according to the principles of the present invention for a five string bass.

The circuit for implementing this is illustrated in FIG. 13 and is similar to that of FIG. 11. The transducer 42 (each showing the letter which corresponds to the note) is connected through buffer 60 to the equalization curve circuit 52. These equalized signals are then combined in mixer 62 and provided to the equalization circuit which includes a low end rolloff filter 50 and a notch filter 58. The output is provided to output circuit 46.

The selection of which of the tuned frequency range to emphasize is a function of which frequencies of the tuned string is not being picked up efficiently or effectively by the transducer 42. In the examples of FIGS. 10–13, the transducer is placed at the bridge 20. Therefore, it is the fundamental or the lower harmonics which are not effectively picked up or present at the transducer. As a transducer moves further along the string towards the nut 24, the amplitude of different harmonics diminish. It should also be noted that if magnetic pickups are used, the same principle would apply, namely those harmonics which are not effectively or efficiently measured at the location of the transducer are boosted or amplified so as to produce a signal having a desired balance of the fundamental frequency and its harmonics.

The output circuit 46 may include a digital signal processing chip for each string for modeling or may include a MIDI switching or other electronically varying signal device. It should also be noted that the signal processing circuits 44 may also include digital signal processing. The digital signal processor can determine the fundamental or harmonic frequencies of the string being played and appropriately adjusts the fundamental/harmonic equalization to more closely and narrowly follow the change in fundamental and harmonics of the string. This will require no adjustment by the player as they adjust the frequency of the string by fretting, capoing or other tuning mechanisms.

By providing an individual transducer for each string that is tuned to a different frequency and signal processing circuit which is tuned to emphasize signals characteristic of that string and de-emphasize signals not characteristic of that string, a more accurate signal may be provided which better emulates the acoustic string instrument. Where the instrument has more than one string tuned to the same frequency, one transducer can be used to pick up the signal from both strings or an individual transducer can be used for each string and a single signal processing circuit may be provided for each pair of strings. This is because the signal processing circuit is designed for that particular tuned frequency of the string.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A musical instrument having a plurality of strings each individually tuned to a frequency, a signal circuit for each string and an output circuit connected to the signal circuits, wherein each signal circuit comprising:

a transducer adjacent a string;

an equalizer connecting the transducer to the output circuit; and the equalizer being set to a frequency range of the tuned string to emphasize, within a signal from the transducer, one or more of (a) the fundamental of the tuned string, (b) one of the harmonics above the fundamental of the tuned string, and (c) two of the harmonics above the fundamental of the tuned string.

2. A musical instrument according to claim 1, wherein the equalizer for a higher frequency tuned string is tuned to a frequency range including the fundamental and a second harmonic of the tuned string and the equalizer for a lower frequency tuned string is tuned to a frequency range including the second harmonic of the tuned string.

3. A musical instrument according to claim 1, wherein the equalizer de-emphasizes low end frequencies below the fundamental of the tuned string.

4. A musical instrument according to claim 1, wherein the equalizer also de-emphasizes an inherent resonance signal produced by the transducer at a characteristic frequency of the transducer.

5. A musical instrument according to claim 1, wherein the equalizer includes a filter to de-emphasize an inherent resonance signal produced by the transducer at a characteristic frequency of the transducer.

6. A musical instrument according to claim 1, wherein the equalizer includes a low end filter which de-emphasizes the low end frequencies and a high end filter which de-emphasizes the high end frequencies.

7. A musical instrument according to claim 1, wherein the equalizer modifies mid-range frequencies to emulate acoustic musical string instruments.

8. A musical instrument according to claim 1, wherein the musical instrument is a guitar having at least six strings each string having a tuned fundamental frequency in a range from an open string's frequency to a fretted string's frequency and including six signal circuits whose equalizer emphasizes only the fundamental frequency within the fundamental frequency range of the respective tuned string.

9. A musical instrument according to claim 1, wherein the fundamental frequency range of the equalizers is one octave of the tuned string.

10. A musical instrument according to claim 1, wherein the musical instrument is from the group of guitar, bass, mandolin, violin, cello, piano and harp.

11. A musical instrument according to claim 1, wherein the equalizer includes a digital signal processor which determines the frequency of the string and emphasizing one or more of the determined frequency and one or more of its harmonics.

12. A musical instrument according to claim 1, wherein the transducer is a piezoelectric transducer.

13. A musical instrument according to claim 1, wherein the transducer includes an inductor.

14. A musical instrument having a plurality of strings each individually tuned to a frequency, a signal circuit for each string and an output circuit connected to the signal circuits, wherein each signal circuit comprising:

a transducer adjacent a string;

an equalizer connecting the transducer to the output circuit; and the equalizer being set to a frequency range of one octave of the tuned string to emphasize, within a signal from the transducer, at least one harmonic of the tuned string.

15. A musical instrument having a plurality of strings each string being individually tuned in frequency, a signal circuit for each string and an output circuit connected to the signal circuits, wherein each signal circuit comprising:

a transducer adjacent a string;

an equalizer connecting the transducer to the output circuit; and the equalizer being set to a frequency range of the tuned string to emphasize, within a signal from the transducer, signals present in the frequency range and de-emphasize at least the low end frequencies below a fundamental of the string.

16. A musical instrument according to claim 15, wherein the output circuit provides a mono output of the combined signal circuits.

17. A musical instrument according to claim 16, including a common filter to de-emphasize an inherent resonance signal produced by the transducer at a characteristic frequency of the transducer connecting all the equalizers to the mono output.

18. A musical instrument according to claim 15, wherein the output circuit provides a stereo output of the combined signal circuits.

19. A musical instrument according to claim 18, including a pair of filters to de-emphasize an inherent resonance signal produced by the transducer at a characteristic frequency of the transducer connecting the equalizers to the stereo outputs.

20. A musical instrument according to claim 15, wherein the output circuit provides an individual output for each of the signal circuits.

21. A musical instrument according to claim 15, wherein the instrument includes a bridge supporting the strings and the transducers for the strings are on the bridge.

22. A musical instrument according to claim 15, wherein the equalizer is tuned to a frequency range including the fundamental frequency of the tuned string.

23. A musical instrument according to claim 15, wherein the equalizer is tuned to a frequency range including one or more harmonics of the fundamental frequency of the tuned string.

24. A method of emphasizing a fundamental frequency of each string of a stringed instrument relative to its harmonic frequencies, the method comprising:

providing a piezoelectric transducer on a bridge of the musical instrument for each string;

emphasizing within a signal from the transducers a specific frequency range of each string within a first octave of the string separately; and combining the signals for each string after emphasizing.

25. A method according to claim 24, including de-emphasizing frequencies below 50 hertz and notch filtering signal at 8000 hertz in the combined signals.

26. A method of emphasizing a harmonic frequencies of each string of a stringed instrument relative to other harmonic frequencies, the method comprising:

providing a piezoelectric transducer on a bridge of the musical instrument for each string;

emphasizing within a signal from the transducers a specific frequency range of each string within a second octave of the string separately; and combining the signals for each string after emphasizing.

27. A method according to claim 26, including de-emphasizing frequencies below 50 hertz and notch filtering signal at 8000 hertz in the combined signals.

* * * * *